US010257637B2

(12) United States Patent
Di Censo et al.

(10) Patent No.: US 10,257,637 B2
(45) Date of Patent: Apr. 9, 2019

(54) SHOULDER-MOUNTED ROBOTIC SPEAKERS

(71) Applicant: Harman International Industries, Incorporated, Stamford, CT (US)

(72) Inventors: Davide Di Censo, Oakland, CA (US); Stefan Marti, Oakland, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 15/570,721

(22) PCT Filed: Jun. 30, 2015

(86) PCT No.: PCT/US2015/038672
§ 371 (c)(1),
(2) Date: Oct. 30, 2017

(87) PCT Pub. No.: WO2017/003472
PCT Pub. Date: Jan. 5, 2017

(65) Prior Publication Data

US 2018/0295462 A1 Oct. 11, 2018

(51) Int. Cl.
*H04S 7/00* (2006.01)
*H04R 1/34* (2006.01)
(Continued)

(52) U.S. Cl.
CPC ..... *H04S 7/303* (2013.01); *G10K 11/178* (2013.01); *H04R 1/345* (2013.01); *H04R 1/403* (2013.01); *H04R 1/406* (2013.01); *H04R 5/02* (2013.01); *H04R 3/04* (2013.01); *H04R 2201/023* (2013.01); *H04R 2201/025* (2013.01); *H04R 2201/401* (2013.01); *H04R 2217/03* (2013.01);
(Continued)

(58) Field of Classification Search
CPC .. H04S 7/303; H04S 2400/11; H04S 2420/01; G10K 11/178; H04R 1/403; H04R 1/406; H04R 5/02; H04R 2201/401
USPC ..... 381/56, 58, 124, 303, 313, 387
See application file for complete search history.

(56) References Cited

U.S. PATENT DOCUMENTS

2001/0055397 A1* 12/2001 Norris ..... G10H 1/0091 381/79
2011/0103614 A1* 5/2011 Cheung ..... H04R 1/403 381/94.1
(Continued)

FOREIGN PATENT DOCUMENTS

WO 2004093488 A2 10/2004

OTHER PUBLICATIONS

International Search Report Application No. PCT/2015/038672, dated Apr. 3, 2016, 8 pages.

*Primary Examiner* — William A Jerez Lora
(74) *Attorney, Agent, or Firm* — Artegis Law Group, LLP

(57) ABSTRACT

One embodiment of the present invention sets forth a technique for transmitting an audio event to an ear of a user. The technique includes acquiring sensor data associated with the ear of the user and analyzing the sensor data to determine a position of the ear. The technique further includes determining a speaker orientation based on the position of the ear and a location of a shoulder-mounted speaker. The technique further includes causing the shoulder-mounted speaker to transmit the audio event to the ear of the user based on the speaker orientation.

20 Claims, 5 Drawing Sheets

(51) Int. Cl.

| | |
|---|---|
| ***H04R 1/40*** | (2006.01) |
| ***H04R 5/02*** | (2006.01) |
| ***G10K 11/178*** | (2006.01) |
| *H04R 3/04* | (2006.01) |

(52) U.S. Cl.
CPC ..... *H04R 2410/05* (2013.01); *H04R 2430/01* (2013.01); *H04R 2460/01* (2013.01); *H04S 2400/11* (2013.01); *H04S 2420/01* (2013.01)

(56) References Cited

U.S. PATENT DOCUMENTS

| | | | | |
|---|---|---|---|---|
| 2013/0182865 | A1* | 7/2013 | Paul | G10K 11/178 381/71.8 |
| 2015/0245159 | A1* | 8/2015 | Osman | H04S 7/304 381/303 |
| 2016/0148057 | A1* | 5/2016 | Oh | H04N 7/183 348/143 |
| 2016/0174011 | A1* | 6/2016 | Rider | H04S 7/303 381/303 |
| 2016/0234587 | A1* | 8/2016 | Kappus | H04R 1/28 |

* cited by examiner

SHOULDER-MOUNTED ROBOTIC SPEAKERS

CROSS-REFERENCE TO RELATED APPLICATIONS

The present application is a national stage application of the international application titled, "SHOULDER-MOUNTED ROBOTIC SPEAKERS," filed on Jun. 30, 2015 and having application number PCT/US2015/038672. The subject matter of this related application is hereby incorporated herein by reference.

BACKGROUND

Field of the Embodiments of the Invention

Embodiments of the present invention relate generally to audio systems and, more specifically, to shoulder-mounted robotic speakers.

Description of the Related Art

Many consumer electronic devices, such as smartphones, media players, tablets, and personal computers, rely on headphones, built-in speakers, and/or external speakers (e.g., compact, portable speakers) to enable a user to listen to audio content generated by the device. For example, smartphones and portable media players typically include a physical headphone connector and/or a wireless audio interface through which audio signals are passed. A user may then couple a pair of headphones or a speaker system to the device via the connector or wireless interface in order to listen to audio content generated by the device.

Headphones present various drawbacks. In particular, although headphones are capable of providing a high-fidelity audio experience in wide variety of listening environments, wearing headphones reduces the degree to which a user can listen to and interact with his or her environment. For example, wearing headphones may isolate the user from important sounds within an environment, such as the sound of a vehicle traveling near the user or the voice of a person trying to speak to the user. Further, wearing headphones may be obtrusive and/or socially unacceptable in certain situations, such as when a user is in a meeting, in a formal setting, and/or having a conversation with another person.

External speakers present various drawbacks too. In particular, although an external speaker system enables a user to listen to audio content without being isolated from the surrounding environment, sound emanating from such a system may disturb other persons in the vicinity of the user. Moreover, an external speaker system implementation is impractical when a user prefers to keep the audio content produced by the device private, such as during a telephone conversation or when listening to audio content that is personal in nature.

As the foregoing illustrates, techniques that enable a user to more effectively listen to audio content produced by mobile and hand-held devices would be useful.

SUMMARY

One embodiment of the present invention sets forth a system for transmitting an audio event to an ear of a user. The system includes at least one sensor configured to acquire sensor data associated with the ear of the user. The system further includes a processor coupled to the at least one sensor and configured to analyze the sensor data to determine a position of the ear and determine a speaker orientation based on the position of the ear and a location of a shoulder-mounted speaker. The system further includes the shoulder-mounted speaker configured to transmit the audio event to the ear of the user according to the speaker orientation.

Further embodiments provide, among other things, a method and a non-transitory computer-readable medium configured to implement the system set forth above.

At least one advantage of the disclosed techniques is that audio events can be transmitted directly to the ears of a user, enabling the user to listen to audio content (e.g., music, voice conversations, notifications, etc.) without disturbing those around him or her. Additionally, because the audio system is shoulder-mounted, not head mounted, the system does not isolate the user from sounds in his or her environment. Further, the audio system may be used in situations where a head mounted device may not be socially acceptable. In some embodiments, the audio system further enables the user to cancel and/or enhance specific noises and sounds in his or her environment without requiring a head mounted device to be worn.

BRIEF DESCRIPTION OF THE SEVERAL VIEWS OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous specific details are set forth to provide a more thorough understanding of the embodiments of the present invention. However, it will be apparent to one of skill in the art that the embodiments of the present invention may be practiced without one or more of these specific details.

Figure 1:
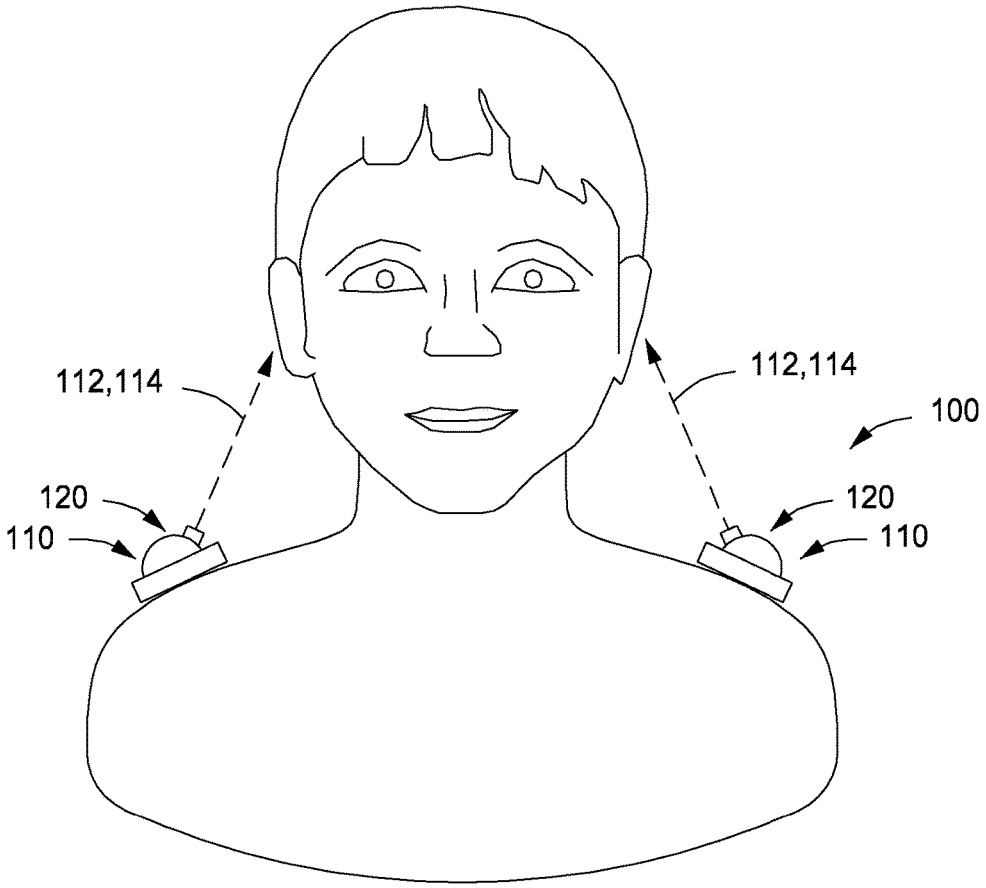
FIG. 1 illustrates an audio system that generates audio events via highly-directional speakers, according to various embodiments.

FIG. 1 illustrates an audio system 100 that generates audio events via highly-directional speakers 110, according to various embodiments. As shown, the audio system 100 includes one or more highly-directional speakers 110 positioned proximate to (e.g., mounted on) the shoulders of a user. The audio system 100 further includes a computing device (not shown) that may be coupled to and/or integrated with one or both of the highly-directional speakers 110. In some embodiments, the highly-directional speakers 110 are disposed in a larger assembly (e.g., a harness) that is positioned on the shoulders of the user. In other embodiments, the highly-directional speakers 110 are coupled to an item of clothing (e.g., a jacket, sweater, shirt, etc.) being worn by the user, built into an item of clothing (e.g., built into shoulder pads of an item of clothing), or integrated in jewelry (e.g., a necklace).

In various embodiments, the position of an ear of a user is tracked by a sensor 120 and used to determine an orientation in which a highly-directional speaker 110 should be positioned in order to cause audio events to be transmitted to the ear. For example, and without limitation, the sensor 120 may track the position of the ear and provide this information to a processing unit included in the audio system 100. The audio system 100 then uses the position of the ear to determine a speaker orientation that will enable the corresponding highly-directional speaker 110 to transmit audio events directly to the ear, without disturbing others in the surrounding environment. In some embodiments, the speaker orientation is determined by computing a vector 114 (e.g., a three-dimensional vector) from a location of a highly-directional speaker 110 (e.g., a driver included in a highly-directional speaker 110) to the position of an ear of the user.

The highly-directional speakers 110 may be configured to emit sound waves 112 having very low beam divergence, such that a narrow cone of sound may be transmitted in a specific direction (e.g., towards an ear of the user). For example, and without limitation, when directed towards an ear of the user, sound waves 112 generated by a highly-directional speaker 110 are audible to the user but may be substantially inaudible to other people that are proximate to the user.

In some embodiments, the highly-directional speaker 110 generates a modulated sound wave 112 that includes two ultrasound waves. One ultrasound wave serves as a reference tone (e.g., a constant 200 kHz carrier wave), while the other ultrasound wave serves as a signal, which may be modulated between about 200, 200 Hz and about 220,000 Hz. Once the modulated sound wave 112 strikes an object (e.g., a user's head), the ultrasound waves slow down and mix together, generating both constructive interfere and destructive interference. The result of the interference between the ultrasound waves is a third sound wave having a lower frequency, typically in the range of about 200 Hz to about 20,000 Hz. In some embodiments, an electronic circuit attached to piezoelectric transducers constantly alters the frequency of the ultrasound waves (e.g., by modulating one of the waves between about 200,200 Hz and about 220,000 Hz) in order to generate the correct, lower-frequency sound waves when the modulated sound wave 112 strikes an object. The process by which the two ultrasound waves are mixed together is commonly referred to as "parametric interaction."

In various embodiments, one or more of the sensors 120 may dynamically track head movements of the user (e.g., the positions and/or orientations of the ears and/or head of the user) in order to generate a consistent and realistic audio experience, even when the user tilts or turns his or her head. For example, and without limitation, the sensors 120 may identify an ear of the user via an object recognition algorithm and subsequently track the position of the ear relative to the audio system 100 (e.g., relative to a highly-directional speaker 110 associated with the ear). The position of the ear may then be used to determine an orientation in which the highly-directional speaker 110 should be positioned.

Additionally, in some embodiments, the sensors may determine the position and/or orientation of the head of the user, such as whether the head is facing forward, turned to the side, and/or tilted to the side, front, or back. The position of the ears may then be determined based on the position and/or orientation of the head, or the position and/or orientation of the head may be used to increase the accuracy with which the positions of the ears are determined. For example, and without limitation, when the audio system 100 determines (e.g., via a sensor 120) that the head of the user is turned to the right, the audio system 100 may infer that, relative to a sensor 120 located on the right shoulder of the user, the position of the right ear of the user has moved to the left. In response, the highly-directional speaker 110 positioned on the right shoulder of the user may pan to the left in order to target the new position of the right ear of the user. In some embodiments, the audio system 100 can vary the volume of each of the highly-directional speakers 110 according to the head/ear position and/or the distance between the highly-directional speaker 110 and the ear so that the user perceives himself or herself as being at the center of an augmented sound space (e.g., the center of a stereo sound space). In another non-limiting example, when the audio system 100 determines (e.g., via a sensor 120) that the head of the user is turned to the left, the audio system 100 may determine that the highly-directional speaker 110 positioned on the right shoulder of the user does not have line-of-sight to the right ear of the user. Under such circumstances, transmission of sound waves 112 to the right ear of the user may be terminated until the user repositions his or her right ear (e.g., by facing forward).

Additionally, in various embodiments, the shape of a user's ear(s) may be taken into account when generating audio events via a highly-directional speaker 110. For example, and without limitation, data acquired by a sensor 120 could be used to determine the shape of one or more parts of the ear, such as the pinna (outer ear). Sound parameters associated with an audio event could then be modified based on the shape of the ear in order to generate audio events that are customized for a particular user. Further, accounting for the shape of a user's ear may enable the audio system 100 to generate a more accurate sound experience, where audio events are perceived by the user as being located at specific locations in a sound space, without needing to change the physical location of the highly-directional speaker 110. Such techniques also may be implemented to generate noise cancellation signals which cancel out specific noises that come from specific directions relative to the user. Similarly, accounting for ear shape when generating audio events may enable the audio system 100 to enhance a sound in the environment while accurately maintaining the specific directionality of the original sound, as perceived by the user. In some embodiments, audio events may be modified based on one or more head-related transfer functions (HRTFs) that characterize how a particular user's ear drum receives a sound from various points in space. Accordingly, taking into account ear shape may enable the audio system 100 to more accurately control the direction from which audio events are perceived by a user.

In some embodiments, instead of (or in addition to) tracking the ear and/or head of a user, the sensor 120 may track other characteristics of the user. For example, and without limitation, the sensor 120 may analyze the visual appearance of the user to determine and/or dynamically track features such as a hairline (e.g., sideburns), facial features (e.g., eyes, nose, mouth, lips, cheeks), neck, and/or head-worn items (e.g., an earring, hat, headband). The position of the ear may then be determined, inferred, and/or confirmed based on the positions(s) of one or more of these features. In a specific non-limiting example, the position of the ear of a user relative to his or her unique hairline may be determined. The position of the ear may then be determined, inferred, and/or confirmed based on the positions and/or orientation of the hairline. Advantageously, the hairline of the user (or another feature mentioned above) may be more visible to the sensor 120 under certain circumstances. Accordingly, tracking the position of such a feature, and then determining the position of the ear relative to the feature, may increase the accuracy and reliability of the audio system 100.

The sensors 120 may implement any sensing technique that is capable of tracking the ear(s) and/or head of a user. In some embodiments, the sensors 120 include a visual sensor, such as a camera (e.g., a stereoscopic camera). In such embodiments, the sensors 120 may be further configured to perform object recognition in order to determine the position and/or orientation of an ear and/or head of the user. Additionally, in some embodiments, the sensors 120 include ultrasonic sensors, radar sensors, laser sensors, thermal sensors, and/or depth sensors, such as time-of-flight sensors, structured light sensors, and the like.

Figure 2A:
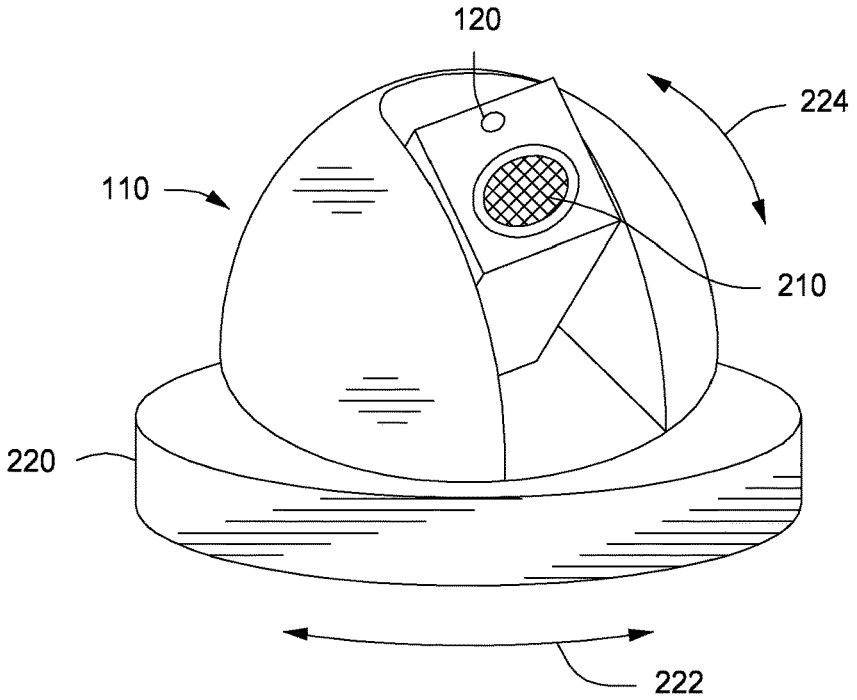
FIGS. 2A and 2B illustrate highly-directional speakers that may be implemented in conjunction with the audio system of FIG. 1, according to various embodiments.
Figure 2B:
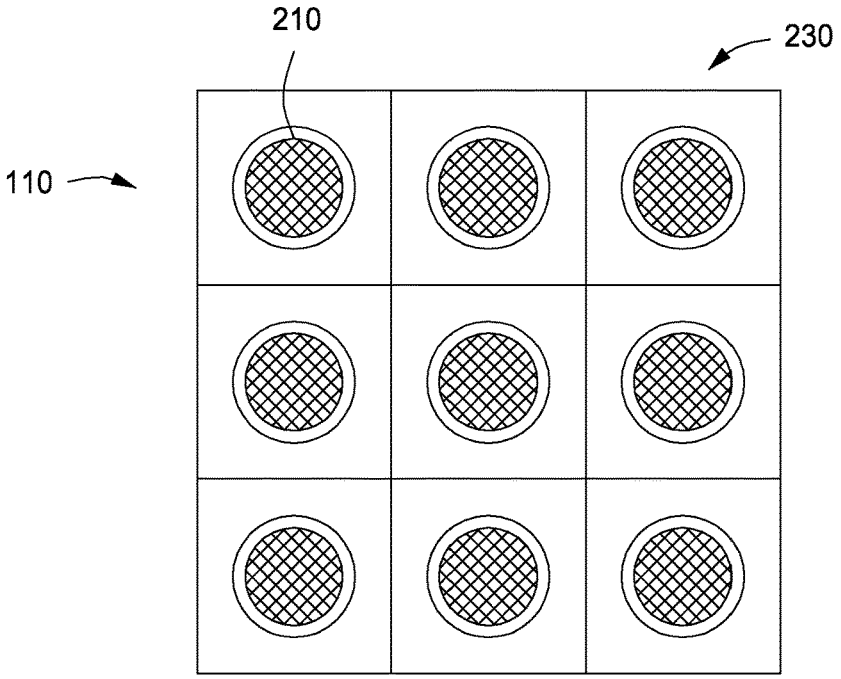

FIGS. 2A and 2B illustrate highly-directional speakers 110 that may be implemented in conjunction with the audio system 100 of FIG. 1, according to various embodiments. As shown in FIG. 2A, the highly-directional speaker 110 may include one or more drivers 210 coupled to a pan-tilt assembly 220. In some embodiments, the pan-tilt assembly 220 is a low-profile assembly that can be integrated into clothing, a shoulder-mounted assembly, etc. The highly-directional speaker 110 may also include one or more sensors 120.

The pan-tilt assembly 220 is operable to orient the driver 210 towards a position of an ear at which an audio event is to be transmitted. Sound waves 112 (e.g., ultrasound carrier waves and audible sound waves associated with an audio event) are then generated by the driver 210 and transmitted towards the ear, causing the audio event to be heard by the user while, in some embodiments, remaining substantially inaudible to others near the user. Accordingly, the audio system 100 is able to track the position of the ears of the user and transmit audio events to the ears. One type of driver 210 that may be implemented in the highly-directional speakers 110 in various embodiments is a hypersonic sound speaker (HSS) driver, such as the drivers implemented in the Audio Spotlight speakers produced by Holosonic® (Holosonic Research Labs, Inc., Watertown, Mass., USA). However, any other type of driver or loudspeaker that is capable of generating sound waves 112 having very low beam divergence may be implemented with the various embodiments disclosed herein.

The pan-tilt assembly 220 may include one or more robotically controlled actuators that are capable of panning 222 and/or tilting 224 the driver 210 relative to a base in order to orient the driver 210 towards an ear of the user. The pan-tilt assembly 220 may be similar to assemblies used in surveillance systems, video production equipment, etc. and may include various mechanical parts (e.g., shafts, gears, ball bearings, etc.), and actuators that drive the assembly. Such actuators may include electric motors, piezoelectric motors, hydraulic and pneumatic actuators, or any other type of actuator. The actuators may be substantially silent during operation and/or an active noise cancellation technique (e.g., noise cancellation signals generated by the highly-directional speaker 110) may be used to reduce the noise generated by movement of the actuators and pan-tilt assembly 220. In some embodiments, the pan-tilt assembly 220 is capable of turning and rotating in any desired direction, both vertically and horizontally. Accordingly, the driver(s) 210 coupled to the pan-tilt assembly 220 can be pointed in any desired direction to match changes to the position and orientation of the head of the user. In other embodiments, the assembly to which the driver(s) 210 are coupled is capable of only panning 222 or tilting 224, such that the orientation of the driver(s) 210 can be changed in either a vertical or a horizontal direction.

In some embodiments, one or more sensors 120 are mounted separately from the highly-directional speaker(s) 110. For example, and without limitation, one or more sensors 120 may be mounted separately on the shoulders of the user (e.g., in an article of clothing) or in an electronic device (e.g., a mobile device) being carried by the user. Additionally, one or more sensors 120 may be mounted at fixed positions within the environment (e.g., an automotive environment) in which the user is located. In such embodiments, the one or more sensors 120 may be mounted within the listening environment in a manner that allows the audio system 100 to maintain a substantially complete view of the user, enabling the head, ears, facial features, etc. of the user to be more effectively tracked.

In some embodiments, the highly-directional speaker 110 includes multiple drivers 210 arranged in an array, grid, pattern, etc., as shown in FIG. 2B. In such embodiments, some or all of the drivers 210 may have different static orientations. Then, during operation of the audio system 100, one of more of the drivers 210 may be selected based on the position of the ear of the user. For example, and without limitation, when the ear of the user is in a first position, a first driver 210 included in an array and having a first orientation directed at the first position may be selected to transmit the sound waves 112 associated with an audio event. Then, when the ear of the user moves to a second position, a second driver 210 included in the array and having a second orientation directed at the second position may be selected to transmit the sound waves 112 associated with an audio event. In other embodiments, one or more of the drivers 210 included in the array may be panned and/or tilted in order to orient one or more drivers 210 towards an ear of the user.

Additionally, static drivers 210 and/or movable drivers 210 may be implemented in conjunction with digital signal processing (DSP) techniques that enable the sound waves 112 to be steered in specific directions (e.g., via beamforming and/or generating constructive/destructive interference between sound waves 112 produced by the drivers 210) relative to the array of drivers 210. That is, the dominant direction of the sound waves 112 may be controlled so that a user at which the sound waves 112 are directed can hear an audio event, but the audio event is attenuated or substantially inaudible to others that are not in the path of the dominant direction of the sound waves 112. Such embodiments enable audio events to be transmitted in different directions (e.g., according to different speaker orientations determined based on a dynamic position of an ear) without requiring moving parts. Additionally, such DSP techniques may be quicker and more responsive than mechanically reorienting the drivers 210 each time the position of the ear changes relative to the shoulders of the user.

Figure 3:
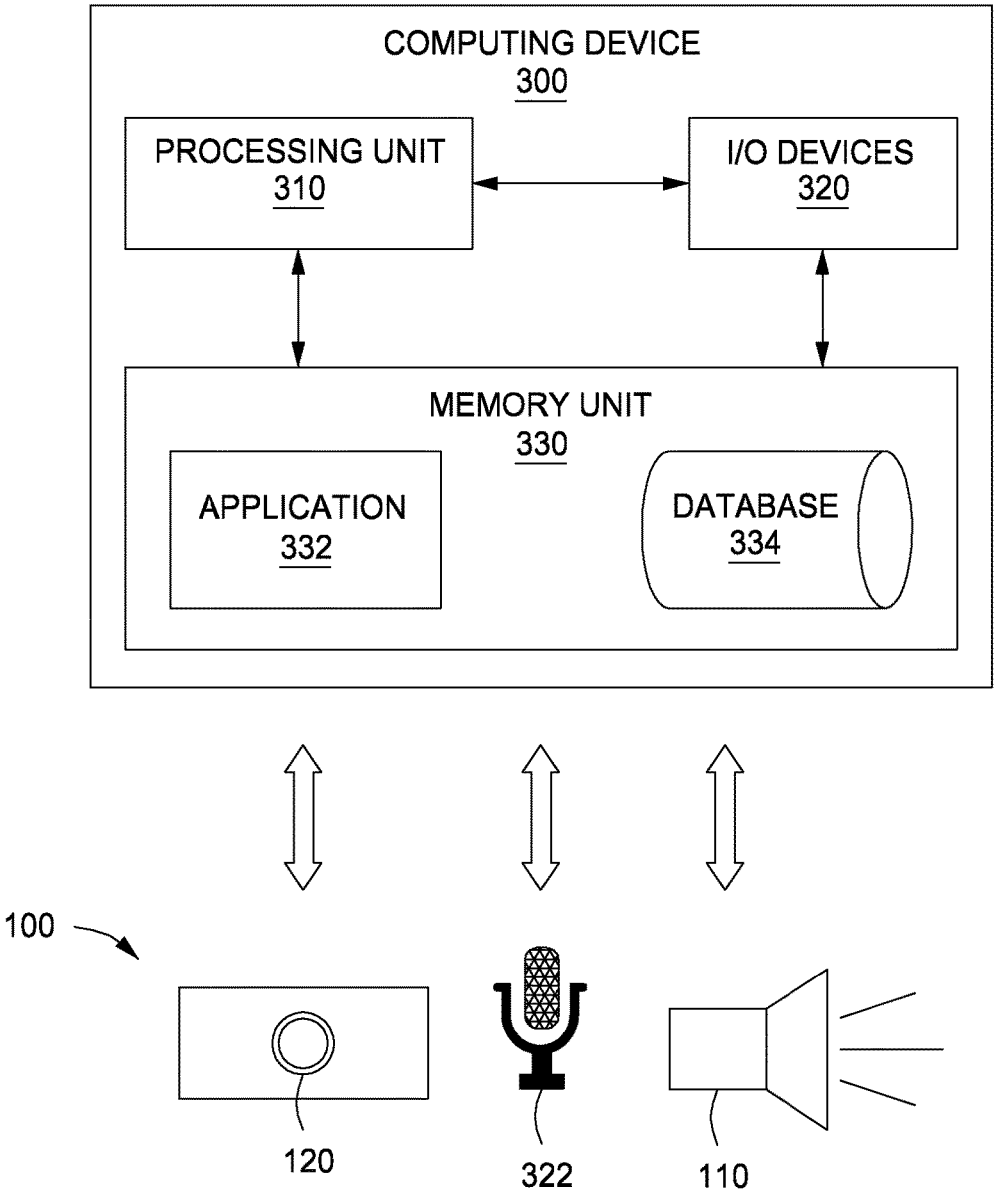
FIG. 3 is a block diagram of a computing device that may be implemented in conjunction with or coupled to the audio system of FIG. 1, according to various embodiments.

FIG. 3 is a block diagram of a computing device 300 that may be implemented in conjunction with or coupled to the audio system 100 of FIG. 1, according to various embodiments. As shown, computing device 300 includes a processing unit 310, input/output (I/O) devices 320, and a memory device 330. Memory device 330 includes an application 332 configured to interact with a database 334. The computing device 300 is coupled to one or more highly-directional speakers 110 and one or more sensors 120.

Processing unit 310 may include a central processing unit (CPU), digital signal processing unit (DSP), and so forth. In various embodiments, the processing unit 310 is configured to analyze data acquired by the sensor(s) 120 to determine locations, distances, orientations, etc. of the user, visual features of the user, and the like. The locations, distances, orientations, etc. of the user, the visual features, etc. may be stored in the database 334. The processing unit 310 is further configured to compute a vector 114 from a location of a highly-directional speaker 110 to a position of an ear of the user based on the locations, distances, orientations, etc. of the user, the visual features, etc. For example, and without limitation, the processing unit 310 may receive data from the sensor 120 and process the data to dynamically track the movements of the head and/or ear of the user. Then, based on changes to the position and orientation of the head and/or ear of the user, the processing unit 310 may compute one or more vectors 114 that cause an audio event generated by a highly-directional speaker 110 to be transmitted directly to the ear of the user. The processing unit 310 then determines, based on the one or more vectors 114, an orientation in which the driver(s) 210 of the highly-directional speaker 110 should be positioned to transmit the audio event to the ear of the user. Accordingly, the processing unit 310 may communicate with/control the pan-tilt assembly 220 and/or a DSP module included in an array of drivers 210.

In some embodiments, the processing unit 310 may further acquire sound data via a microphone 322 and generate one or more cancellation signals to cancel ambient noise in the environment of the user. The cancellation signals are then transmitted to the ears of the user via the highly-directional speakers 110. For example, and without limitation, the processing unit 310 may determine that sound data acquired by the microphone 322 substantially matches a set of sound parameters (e.g., frequency characteristics) associated with a noise (e.g., vehicle noise, construction noise, crowd noise, etc.) to be blocked by the audio system 100. In response, the processing unit 310 may generate one or more cancellation signals (e.g., inverted phase signals) and cause the cancellation signal(s) to be transmitted to the ears of the user via the highly-directional speakers 110 so that the user does not hear the noise in the surrounding environment.

Additionally, in some embodiments, the processing unit 310 processes sound data acquired via the microphone 322 and generates one or more enhanced signals in order to emphasize or augment certain sounds in the environment of the user. The enhanced signals are then transmitted to the ears of the user via the highly-directional speakers 110. For example, and without limitation, the processing unit 310 may determine that sound data acquired by the microphone 322 substantially matches a set of sound parameters (e.g., frequency characteristics) associated with a sound (e.g., a voice, an approaching vehicle, an auditory alert, etc.) to be enhanced by the audio system 100. In response, the processing unit 310 may amplify certain characteristics of the sound and cause the enhanced signal(s) to be transmitted via the highly-directional speakers so that the user can better hear the sound. Moreover, the enhancement function and cancellation function can be enabled simultaneously in order to augment certain sounds and block certain sounds.

In some embodiments, the processing unit 310 executes an application 332 that generates a user interface (UI) which enables a user to specify which noises and sounds should be cancelled and/or enhanced by the audio system. For example, a user may interact with a UI generated by the application 332 by saying "cancel traffic noise." In response, the application 332 may communicate with a microphone 322 and/or DSP in order to identify (e.g., via sound data acquired by the microphone 322) traffic noise in the surrounding environment, generate an inverted phase signal associated with the traffic noise, and cause the inverted phase signal to be transmitted to the ear(s) of the user via one or more highly-directional speakers 110.

I/O devices 320 may include input devices, output devices, and devices capable of both receiving input and providing output. For example, and without limitation, I/O devices 320 may include wired and/or wireless communication devices that send data to and/or receive data from the sensor(s) 120, the highly-directional speakers 110, and/or various types of audio-video devices (e.g., mobile devices, DSPs, amplifiers, audio-video receivers, and the like) to which the audio system 100 may be coupled. Further, in some embodiments, the I/O devices 320 include one or more wired or wireless communication devices that receive audio events (e.g., via a network, such as a local area network and/or the Internet) that are to be reproduced by the highly-directional speakers 110.

Memory unit 330 may include a memory module or a collection of memory modules. Software application 332 within memory unit 330 may be executed by processing unit 310 to implement the overall functionality of the computing device 300, and, thus, to coordinate the operation of the audio system 100 as a whole. The database 334 may store digital signal processing algorithms, audio events, object recognition data, position data, orientation data, and the like.

Computing device 300 as a whole may be a microprocessor, a system-on-a-chip (SoC), a mobile computing device such as a tablet computer or cell phone, a media player, and so forth. In other embodiments, the computing device 300 may be coupled to, but separate from the audio system 100. In such embodiments, the audio system 100 may include a separate processor that receives data (e.g., audio events) from and transmits data (e.g., sensor data) to the computing device 300, which may be included in a consumer electronic device, such as a smartphone, portable media player, personal computer, vehicle head unit, navigation system, and the like. For example, and without limitation, the computing device 300 may communicate with an external device that provides additional processing power. However, the embodiments disclosed herein contemplate any technically feasible system configured to implement the functionality of the audio system 100.

Figure 4A:
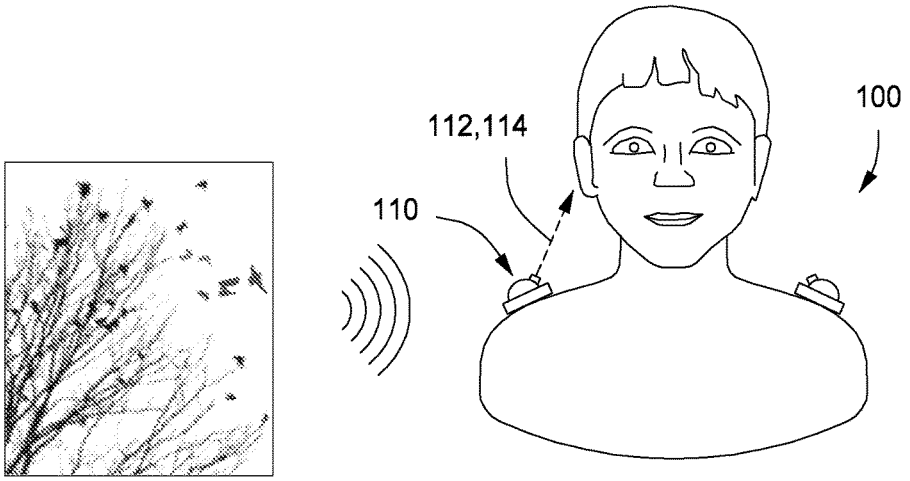
FIGS. 4A and 4B illustrate a user listening to audio events via the audio system of FIG. 1 within a listening environment, according to various embodiments.
Figure 4B:
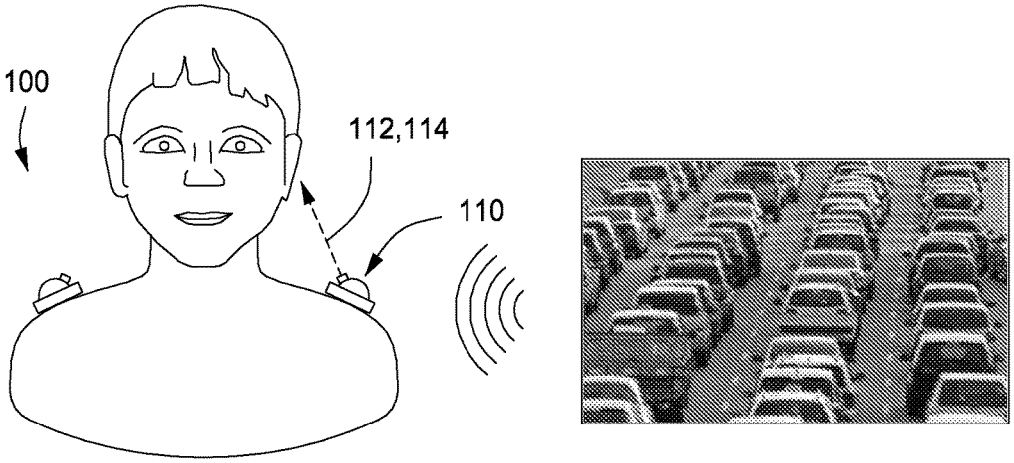

FIGS. 4A and 4B illustrate a user listening to audio events via the audio system 100 of FIG. 1 within a listening environment, according to various embodiments. As described herein, in various embodiments, the sensor 120 may be implemented to track the position of an ear of the user. A highly-directional speaker 110 may then transmit (e.g., via an ultrasound carrier wave) an audio event to the ear of the user. For example, and without limitation, as shown in FIG. 4A, the audio system 100 may be configured to transmit audio events that the user would like to enhance, such as nature sounds (e.g., birds chirping). Accordingly, a microphone 322 coupled to the audio system 100 may acquire sound data from the surrounding environment. The sound data may then be processed to extract and/or enhance the desired sounds, which are then transmitted to the ear(s) of the user by the highly-directional speaker(s) 110. Audio events transmitted to the ears of the user may further include voices of one or more people with which the user is communicating, the voice of a person with which the user is having a private telephone conversation, a music track selected by the user, an auditory alert or notification, and the like. Accordingly, the audio events are reproduced for the user without significantly disturbing others proximate to the user.

Additionally, the audio system 100 may be configured to cancel one or more noises in the environment of the user, as shown in FIG. 4B. For example, and without limitation, the microphone 322 may acquire sound data from the surrounding environment. The sound data may then be processed to isolate a noise the user would like to cancel (e.g., vehicle noise) and to generate a cancellation signal associated with that noise. The cancellation signal is then transmitted (e.g., via ultrasound carrier waves) to the ear(s) of the user by the highly-directional speaker(s) 110, attenuating the noise or rendering the noise substantially inaudible to the user.

Figure 5:
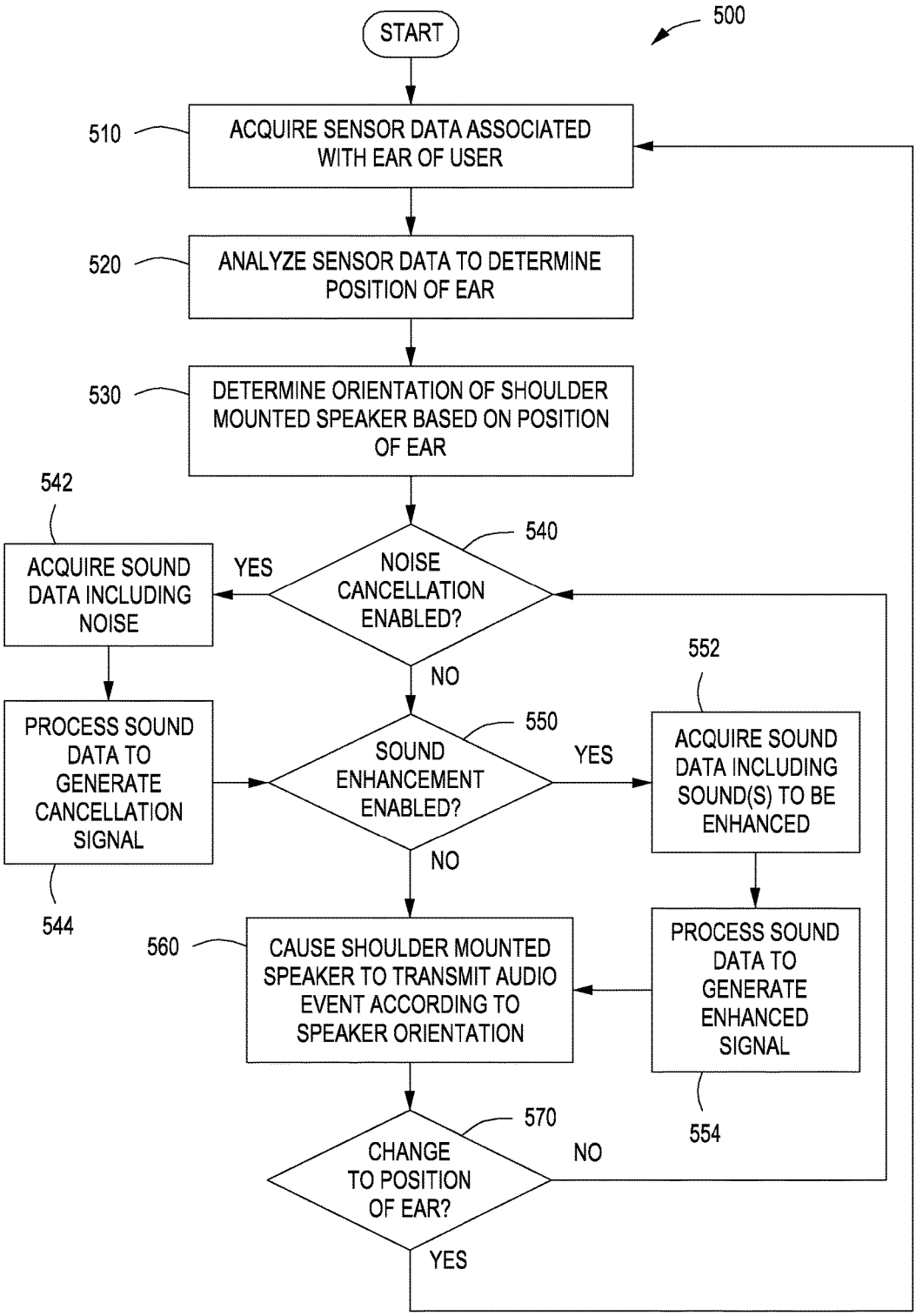
FIG. 5 is a flow diagram of method steps for transmitting an audio event to the ear of a user, according to various embodiments.

FIG. 5 is a flow diagram of method steps for transmitting an audio event to the ear of a user, according to various embodiments. Although the method steps are described in conjunction with the systems of FIGS. 1-4B, persons skilled in the art will understand that any system configured to perform the method steps, in any order, falls within the scope of the present invention.

As shown, a method 500 begins at step 510, where an application 332 executing on the processing unit 310 acquires data associated with the ear of a user (e.g., images of the ear) from a sensor 120 included in one of the highly-directional speakers 110 disposed on one of the shoulders of the user. At step 520, the application 332 analyzes the sensor data to determine a position of the user's ear. As described above, identifying and determining the position of an ear may include determining the position and/or orientation of the ear, the head, and/or facial features, applying one or more object recognition algorithms, and/or performing any other type of sensing technique.

At step 530, the application 332 determines a speaker orientation based on the position of the ear relative to the location of the highly-directional speaker 110 on the shoulder of the user. As described herein, in some embodiments, the speaker orientation may be determined by computing one or more vectors 114 based on the location of the highly-directional speaker 110 on the shoulder of the user and the position of the ear.

Next, at step 540, the application 332 determines whether a noise cancellation function has been enabled. If the application 332 determines that the noise cancellation function has been enabled, then the method 500 proceeds to step 542, where the application 332 acquires sound data via the microphone 322. At step 544, the application 332 then processes the sound data to generate one or more cancellation signals, as described above in conjunction with FIG. 4B. The method 500 then proceeds to step 550.

If, at step 540, the application 332 determines that the noise cancellation function has been not enabled, then the method 500 proceeds to step 550, where the application 332 determines whether a sound enhancement function has been enabled. If the application 332 determines that the sound enhancement function has been enabled, then the method 500 proceeds to step 552, where the application 332 acquires sound data via the microphone 322. At step 554, the application 332 then processes the sound data to generate one or more enhancement signals, as described above in conjunction with FIG. 4A. The method 500 then proceeds to step 560.

If, at step 550, the application 332 determines that the sound enhancement function has not been enabled, then the method 500 proceeds to step 560, where the application 332 causes the highly-directional speaker 110 on the shoulder of the user to transmit an audio event, such as content generated by a user device, a cancellation signal(s), and/or an enhancement signal(s), according to the speaker orientation. As described herein, transmitting an audio event according to a speaker orientation may include positioning (e.g., via a pan-tilt assembly) a driver 210 included in the highly-directional speaker 110 towards the ear of the user and/or causing an array of drivers 210 included in the highly-directional speaker 110 to generate steerable sound waves towards the ear of the user via one or more DSP techniques.

At step 570, the application 332 then determines whether there has been a change to the position of the ear. If there has been a change to the position of the ear, then the method 500 returns to step 510, where additional sensor data is acquired. If there has not been a change to the position of the ear, then the method 500 returns to step 540, where the application 332 again determines whether the noise cancellation function is enabled. For clarity, the method 500 of FIG. 5 has been described in conjunction with one highly-directional speaker 110 mounted on a shoulder of the user. However, the techniques described herein may be implemented via any number of highly-directional speakers 110 mounted on one or both of the shoulders of a user.

In sum, a sensor tracks a position of the ear of a user relative to a highly-directional speaker positioned on a shoulder of the user. The highly-directional speaker then transmits sound waves towards the position of the user's ear in order to generate audio events for the user without significantly disturbing others proximate to the user. The audio events may include, without limitation, content generated by a user device, cancellation signals that cancel some or all of the noise in the surrounding environment, and/or enhancement signals that enhance specific sounds in the surrounding environment.

At least one advantage of the disclosed techniques is that audio events can be transmitted directly to the ears of a user, enabling the user to listen to audio content (e.g., music, voice conversations, notifications, etc.) without disturbing those around him or her. Additionally, because the audio system is shoulder-mounted, not head mounted, the system does not isolate the user from sounds in his or her environment. Further, the audio system may be used in situations where a head mounted device may not be socially acceptable. In some embodiments, the audio system further enables the user to cancel and/or enhance specific noises and sounds in his or her environment without requiring a head mounted device to be worn.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable processors.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The invention has been described above with reference to specific embodiments. Persons of ordinary skill in the art, however, will understand that various modifications and changes may be made thereto without departing from the broader spirit and scope of the invention as set forth in the appended claims. For example, and without limitation, although many of the descriptions herein refer to specific types of highly-directional speakers, sensors, and audio events, persons skilled in the art will appreciate that the systems and techniques described herein are applicable to other types of highly-directional speakers, sensors, and audio events. The foregoing description and drawings are, accordingly, to be regarded in an illustrative rather than a restrictive sense.

While the preceding is directed to embodiments of the present disclosure, other and further embodiments of the disclosure may be devised without departing from the basic scope thereof, and the scope thereof is determined by the claims that follow.

What is claimed is:

1. A system for transmitting an audio event to an ear of a user, the system comprising:

at least one sensor configured to acquire sensor data associated with the ear of the user;

a processor coupled to the at least one sensor and configured to:

analyze the sensor data to determine a position of the ear, determine a speaker orientation based on the position of the ear and a location of a shoulder-mounted speaker that includes a plurality of drivers with different orientations, and select a first driver included in the plurality of drivers based on the speaker orientation; and the shoulder-mounted speaker configured to transmit, via the first driver, the audio event to the ear of the user based on the speaker orientation.

2. The system of claim 1, wherein the drivers included in the plurality of drivers are configured to generate steerable sound waves.

3. The system of claim 2, wherein, to transmit the audio event to the ear of the user, the plurality of drivers generates steerable sound waves that are related to the audio event and have a dominant direction that corresponds to the speaker orientation.

4. The system of claim 1, wherein the shoulder-mounted speaker comprises a pan-tilt assembly coupled to a first driver included in the plurality of drivers.

5. The system of claim 4, wherein, to transmit the audio event to the ear of the user, the pan-tilt assembly positions the first driver according to the speaker orientation, and, while the first driver is positioned according to the speaker orientation, the first driver transmits the audio event to the ear of the user.

6. The system of claim 1, wherein a first driver included in the plurality of drivers is configured to generate an ultrasound carrier wave.

7. The system of claim 6, wherein determining the speaker orientation comprises computing a three-dimensional vector from a location of the first driver to the position of the ear.

8. The system of claim 1, wherein the processor is configured to determine the speaker orientation by:

determining, based on the sensor data, an orientation of a head of the user;

determining the position of the ear based on the orientation of the head of the user; and computing a vector from the location of the shoulder-mounted speaker to the position of the ear.

9. The system of claim 1, further comprising at least one microphone configured to acquire sound data associated with a listening environment of the user, and wherein the processor is further configured to process the sound data to isolate at least one sound included in the sound data, generate an enhancement signal associated with the at least one sound, and cause the shoulder-mounted speaker to transmit the enhancement signal to the ear of the user based on the speaker orientation.

10. A method for transmitting an audio event to an ear of a user, the method comprising:

acquiring sensor data associated with the ear of the user;

analyzing the sensor data to determine a position of the ear;

determining a speaker orientation based on the position of the ear and a location of a shoulder-mounted speaker that includes a plurality of drivers with different orientations;

selecting a first driver included in the plurality of drivers based on the speaker orientation; and causing the shoulder-mounted speaker to transmit, via the first driver, the audio event to the ear of the user based on the speaker orientation.

11. The method of claim 10, wherein causing the shoulder-mounted speaker to transmit the audio event to the ear of the user based on the speaker orientation comprises causing a pan-tilt assembly coupled to the shoulder-mounted speaker to position the shoulder-mounted speaker according to the speaker orientation, and, while the shoulder-mounted speaker is positioned according to the speaker orientation, causing the shoulder-mounted speaker to transmit the audio event to the ear of the user.

12. The method of claim 10, wherein causing the shoulder-mounted speaker to transmit the audio event to the ear of the user based on the speaker orientation comprises generating steerable sound waves via the plurality of drivers included in the shoulder-mounted speaker, wherein the steerable sound waves have a dominant direction that corresponds to the speaker orientation.

13. The method of claim 10, wherein determining the speaker orientation comprises computing a three-dimensional vector from the location of the shoulder-mounted speaker to the position of the ear.

14. The method of claim 10, wherein determining the speaker orientation comprises:

determining, based on the sensor data, an orientation of a head of the user;

determining the position of the ear based on the orientation of the head of the user; and computing a vector from the location of the shoulder-mounted speaker to the position of the ear.

15. The method of claim 14, further comprising:

determining that the orientation of the head of the user has changed;

analyzing the sensor data to determine a second position of the ear of the user;

determining a second speaker orientation based on the second position of the ear; and causing the shoulder-mounted speaker to transmit a second audio event to the ear of the user based on the second speaker orientation.

16. The method of claim 10, further comprising:

acquiring sound data associated with a listening environment of the user;

processing the sound data to generate a cancellation signal; and causing the shoulder-mounted speaker to transmit the cancellation signal to the ear of the user based on the speaker orientation.

17. The method of claim 16, wherein processing the sound data to generate a cancellation signal comprises identifying a noise included in the sound data and generating the cancellation signal based on at least one frequency characteristic of the noise.

18. The method of claim 10, wherein determining the speaker orientation comprises:

determining, based on the sensor data, a location and an orientation of at least one of an eye, a nose, a lip, and a hairline of the user;

determining the position of the ear based on the location and the orientation of the at least one of the eye, the nose, the lip, and the hairline of the user; and computing a vector from the location of the shoulder-mounted speaker to the position of the ear.

19. A non-transitory computer-readable storage medium including instructions that, when executed by a processor, cause the processor to transmit an audio event to an ear of a user, by performing the steps of:

acquiring sensor data associated with the ear of the user;

analyzing the sensor data to determine a position of the ear;

determining a speaker orientation based on the position of the ear and a location of a shoulder-mounted speaker that includes a plurality of drivers with different orientations;

selecting a first driver included in the plurality of drivers based on the speaker orientation; and causing the shoulder-mounted speaker to transmit, via the first driver, the audio event via an ultrasound carrier wave to the ear of the user based on the speaker orientation.

20. The non-transitory computer-readable storage medium of claim 19, wherein determining the speaker orientation comprises computing a three-dimensional vector from the location of the shoulder-mounted speaker to the position of the ear.

* * * * *